US005819564A

United States Patent [19]

Watanuki

[11] Patent Number: 5,819,564

[45] Date of Patent: Oct. 13, 1998

[54] KEY PLATE STRUCTURE FOR AUTOMOBILE

[75] Inventor: Yoshio Watanuki, Ebina, Japan

[73] Assignee: Nissan Motor Co., Ltd., Yokohama, Japan

[21] Appl. No.: 788,265

[22] Filed: Jan. 24, 1997

Related U.S. Application Data

[63] Continuation-in-part of Ser. No. 560,490, Nov. 17, 1995, abandoned.

[30] Foreign Application Priority Data

Dec. 1, 1994 [JP] Japan ..... 6-298222

[51] Int. Cl.[6] ..... F05B 19/04

[52] U.S. Cl. ..... 70/278; 70/408; 70/395

[58] Field of Search ..... 70/408, 278, 277, 70/395, 336, 405, 406, 413, 393

[56] References Cited

U.S. PATENT DOCUMENTS

| | | | |
|---|---|---|---|
| 1,059,759 | 4/1913 | Preston | 70/413 |
| 1,296,165 | 3/1919 | Costuma | 411/910 |
| 3,155,412 | 11/1964 | Edgar | 411/910 |
| 3,729,965 | 5/1973 | Gartner | 70/408 |
| 3,841,120 | 10/1974 | Gartner | 70/408 |
| 4,077,242 | 3/1978 | Sedley | 70/413 |
| 4,200,227 | 4/1980 | Lemelson | 70/336 |
| 4,287,735 | 9/1981 | Brunken et al. | 70/408 |
| 4,305,267 | 12/1981 | Nish et al. | 70/395 |
| 4,516,000 | 5/1985 | Ryberg et al. | 70/408 |
| 4,562,712 | 1/1986 | Wolter | 70/395 |
| 4,888,970 | 12/1989 | Kinzler et al. | 70/408 |
| 4,901,548 | 2/1990 | DesLandes | 70/408 |
| 4,922,736 | 5/1990 | Tanaka et al. | 70/408 |
| 4,936,896 | 6/1990 | Takatsuka | 70/413 |
| 4,998,952 | 3/1991 | Hyatt, Jr. et al. | 70/395 |
| 5,181,605 | 1/1993 | Bishop et al. | 70/408 |
| 5,311,757 | 5/1994 | Spahn | 70/408 |
| 5,433,096 | 7/1995 | Janssen et al. | 70/395 |
| 5,632,168 | 5/1997 | Yano | 70/408 |
| 5,727,408 | 3/1998 | Mizuno et al. | 70/413 |

FOREIGN PATENT DOCUMENTS

| | | | |
|---|---|---|---|
| 1107529 | 8/1981 | Canada | 70/237 |
| 0 224 607 | 6/1987 | European Pat. Off. . | |
| 2448607 | 10/1980 | France | 70/408 |
| 2408468 | 3/1975 | Germany . | |
| 2659285 | 2/1978 | Germany | 70/408 |
| 38 36 458 | 5/1989 | Germany . | |
| 4101461 | 8/1991 | Germany | 70/408 |
| 4141270 | 6/1993 | Germany | 70/408 |
| 4038382 | 2/1992 | Japan | 70/413 |
| 4080482 | 3/1992 | Japan | 70/408 |
| 2155988 | 3/1984 | United Kingdom | 70/408 |
| 2260565 | 4/1993 | United Kingdom | 70/406 |

*Primary Examiner*—Darnell M. Boucher
*Attorney, Agent, or Firm*—Foley & Lardner

[57] ABSTRACT

A key plate structure for an automobile includes a key plate and a key head. The key plate is composed of a head part and a key part while the key head is composed of a casing part made of hard synthetic resin and an outer cover made of soft synthetic resin. The casing part encloses the head part and a part of the key part of the key plate. The outer cover operates to cover the casing part entirely, provided with an opening through which a part of the key part projects outwardly. The casing part has an electronic part installed on one side thereof and adjacent to the key plate. The outer cover has flanges formed on a periphery of the opening while the casing part has projecting rims formed on one edge thereof. In operation, the flanges of the outer cover are urged and fixed on the surfaces of said key plate, respectively, by the projecting rims.

23 Claims, 5 Drawing Sheets

KEY PLATE STRUCTURE FOR AUTOMOBILE

This application is a continuation-in-part of application Ser. No. 08/560,490, Nov. 17, 1995 now abandoned.

BACKGROUND OF THE INVENTION

The present invention relates to a key plate structure used for locking and unlocking a steering apparatus, a door locking device or the like for an automobile.

In a prior art, Japanese Unexamined Utility Model Publication Nos. 3-111766 and 3-121982 etc. disclose an apparatus for preventing an automobile to be stolen where an electronic part such as transponder tips etc. is arranged on a key head of the key plate and magnetically coupled to an annular antenna coil fixed on a periphery of an end of a key cylinder, so that, in case of a specified key plate, a permission signal is generated to a device for controlling a driving of engine, thereby enabling of starting up the engine, while it is prevented to start up the engine in case that any key plate besides the specified key plate is used.

FIGS. 1 to 3 show a representative key plate for locking and unlocking the above-mentioned locking apparatus. In FIG. 1, the key plate 20 includes a key head 22 of synthetic resin having a built-in electronic part 25. In detail, as shown in FIG. 3, the key head 22 includes a casing portion 23 of hard synthetic material which encloses a head part 21 of the key plate 20 and in which the electronic part 25 is incorporated adjacent to the key plate 20. The key casing portion 23 is covered with an outer cover 24 of soft synthetic material, which is molded integral with the portion 23, providing soft feeling for an user.

In the above-mentioned key plate 20, however, a periphery of an opening 24*a* of the outer cover 24, through which a leading end of the key plate 20 projects outwardly, is apt to be lifted from a surface of the key plate 20 due to shrinkage in molding or shrinkage with a lapse of time. Above all, this separating phenomenon is remarkable at upper and lower margins of the opening 24*a* of the outer cover 25 abutting on surfaces 20*a* of the key plate 20 as shown in FIG. 3.

Thus, in the conventional key plate, glue is filled between the margins of the opening 24*a* and the surfaces 20*a* of the key plate 20 in order to prevent the margins from being opened. However, there is raised a problem that the glue flows out thereby to lower the appearance and quality of the key plate. Further, such a countermeasure is expected to be disadvantageous in cost and number of processes.

SUMMARY OF THE INVENTION

It is therefore an object of the present invention to provide a key plate structure for an automobile, which is capable of preventing margins of an outer cover of the key plate structure from opening thereby to further improve the appearance and quality feeling of the structure. The object of the present invention described above can be accomplished by a key plate structure for an automobile, comprising:

a key plate composed of a head part and a key part formed integrally with the head part so as to extending therefrom; and a key head composed of a casing part made of hard synthetic resin for enclosing the head part and a part of the key part of the key plate, the casing part having an electronic part installed on one side thereof and adjacent to the key plate, and an outer cover made of soft synthetic resin for covering the casing part entirely, the outer cover being provided with an opening through which a part of the key part projects outwardly, wherein the outer cover has flanges formed on a periphery of the opening, the flanges extending inside the key head and abutting on opposing surfaces of the key plate, respectively;

wherein the casing part has projecting rims formed on one edge thereof facing a tip of the key part to urge the flanges of the outer cover against the surfaces of the key plate and to fix the flanges on the surfaces, respectively.

With the arrangement mentioned above, even if a force for lifting the periphery of the opening from the surfaces of the key plate is exerted on the outer cover by a shrinkage of the periphery of the opening of the outer cover, the lifting of the periphery from the surfaces of the key plate can be prevented since the flanges are urged against the surfaces by the projecting rims of the casing part. Therefore, it is possible to prevent the opening of the outer cover from being further opened.

In the present invention, preferably, the casing part is provided with a chamber for accommodating the electronic part therein. The chamber is formed so as to open at an end surface of the key head, which directs a tip of the key part of the key plate.

Further, it is preferable that the key plate structure further comprises a synthetic resinous cap which is to be fitted in the chamber for accommodating the electronic part therein firmly and which is provided with a pair of leg parts for engagement with both of side surfaces of the chamber.

Owing to the respective positions of the chamber and the cap for closing it, it is seldom that an user touches an outer surface of the cap with his fingers. Thus, in case that the cap is made of hard synthetic material, there is no problem of producing a sense of incompatibility for the user.

In addition, it is preferable that the outer cover has additional flanges formed about a periphery of an opening of the chamber, the additional flanges also extending inside the key head and abutting on opposing surfaces of the cap, respectively.

Also in this case, since the additional flanges are urged against the opposing surfaces of the cap by the projecting rims of the casing part, it is possible to prevent the opening of the chamber from being further opened.

Preferably, the leg parts are provided at respective tips thereof with hooks while the chamber is provided on opposing side walls thereof with hooking grooves for engagement with the hooks.

By the provision of the hooks and the hooking grooves, the cap can be fitted to the chamber firmly.

More preferably, one of the leg parts of the cap is formed longer than the other leg part while the electronic part is provided on one side thereof with a slanted guide surface which is oblique to an end surface of the electronic part facing the cap. With the arrangement, the cap is fitted in the chamber so that the longer one of the leg part is inserted between the slanted guide surface and one of the opposing side walls of the chamber.

In this case, owing to the wedge type of engagement, it is possible to urge the electronic part against the side wall of the chamber in addition of urging the electronic part against the bottom wall of the chamber, whereby it is possible to fix the electronic part in the chamber firmly without producing any little shaky space. Further, owing to such an assembling form in which the electronic part can be assembled for the first time when the leg part of the cap slidingly engages with the slanted guide surface of the electronic part in fitting the cap into the opening of the chamber, it is possible to exclude such a mistaken assembling that the electronic part is inserted into the chamber in its reversed condition.

More preferably, the slanted guide surface is arranged on a side of the electronic part, which is closer to a corner of the key head than the other opposing side of the electronic part. In this case, it is expected that the electronic part would not be a stumbling block in even a case of forming the corner to be rounded. Therefore, it is possible to increase degree of freedom in modeling the key head.

DESCRIPTION OF THE PREFERRED EMBODIMENT

Figure 1:
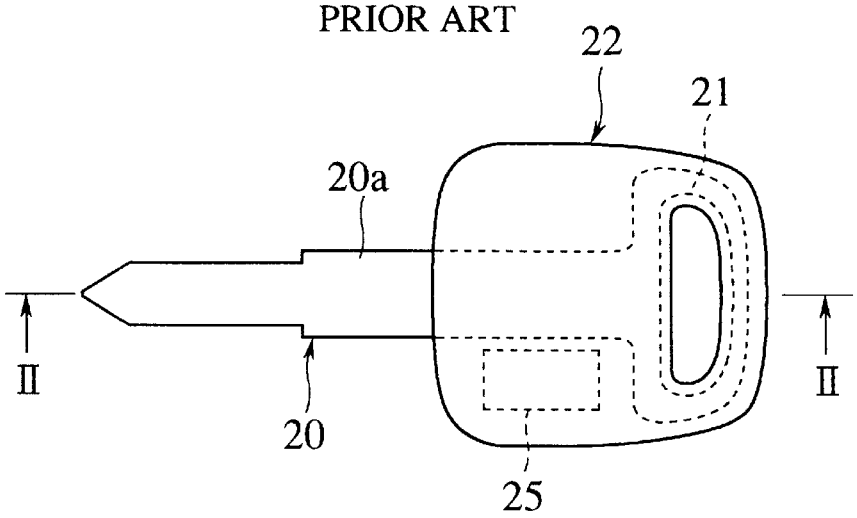
FIG.1 PRIOR ART
FIG. 1 is a plan view showing the conventional key plate structure.
Figure 2:
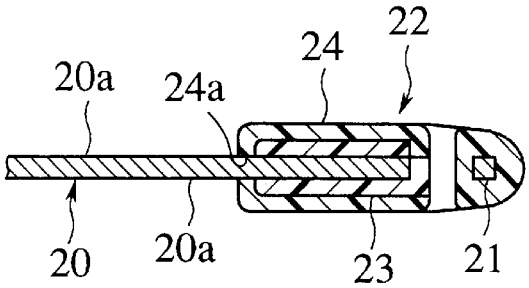
FIG.2 PRIOR ART
FIG. 2 is a cross sectional view of the conventional key plate structure, taken along a line II—II of FIG. 1.
Figure 3:
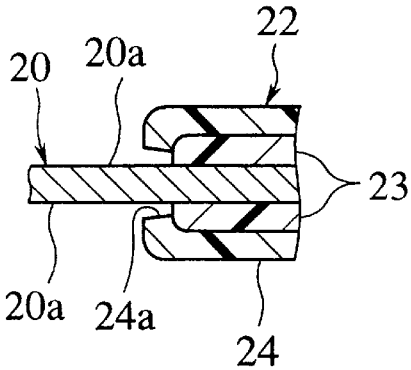
FIG.3 PRIOR ART
FIG. 3 is an enlarged cross sectional view showing an outer cover under an opening condition of margins thereof.

An embodiment of the present invention will be described with reference to the drawings.

In FIGS. 4 to 7, reference numeral 1 designates a key plate consisting of a head part 2*a* and a straight key part 2*b*. Formed integral with the key plate 1 is a synthetic resinous key head 3 which encloses the head part 2*a* and a part of the key part 2*b* of the key plate 1. On one side of the key head 3, it has an electronic part 4, such as transponder tips, installed therein adjacent to the key plate 1.

The key head 3 is composed of a casing part 5 made of hard synthetic resin, such as polypropylene, polyacetal, polycarbonate etc., for enclosing the key plate 1 partially and an outer cover 6 made of soft synthetic resin, such as vinyl chloride resin, rubber resin etc., for covering the casing part 5 generally The casing part 5 is divided into a pair of casing pieces 5*a* and 5*b* interposing the headpart 2*a* and a part of the key part 2*b* in the direction perpendicular to two opposite surfaces 1*a*, 1*a* of the key plate 1. On condition of interposing the key plate 1 through not-shown fastening means mutually provided with the casing pieces 5*a* and 5*b*, the outer cover 6 is molded integral with the key plate 1 by a not-shown mold.

Figure 5:
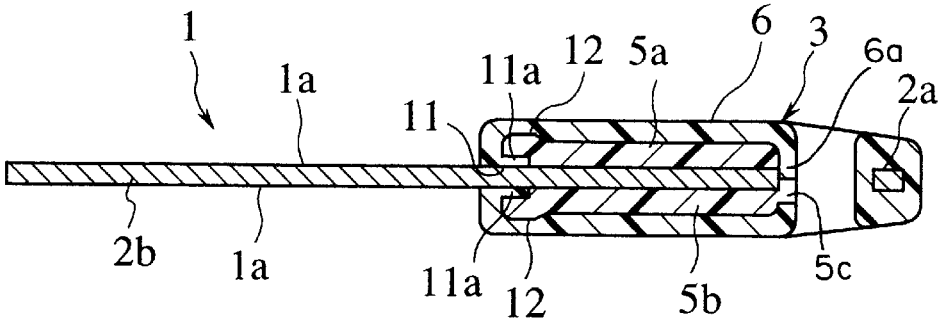
FIG. 5 is a cross sectional view of the key plate structure of the first embodiment invention, taken along a line V—V of FIG. 4.
Figure 6:
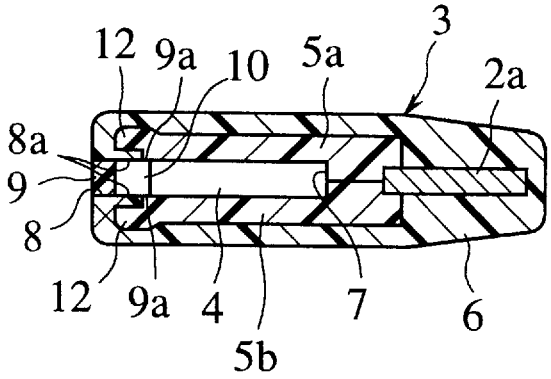
FIG. 6 is a cross sectional view of the key plate structure of the first embodiment of the invention, taken along a line VI—VI of FIG. 4.

As shown in FIG. 5, the first embodiment has the outer cover 6 covering the casing part 5 so that casing piece 5*a* is entirely covered by the outer cover 6 and casing piece 5*b* is covered by the outer cover 6 so that a gap portion 5*c* is exposed to an exterior of the key head 3, more particularly, an exterior of the outer cover 6 through a gap 6*a*.

In the first embodiment, the casing part 5 is provided on one side thereof with a chamber 7 for accommodating the electronic part 4 therein. Note, the chamber will be referred as "receptor part" hereinafter. The receptor part 7 is formed so as to open at a "front" end surface of the key head 3, which directs a tip of the key part 2*b* of the key plate 1. In assembly, the electronic part 4 is inserted into the receptor part 7 through an opening 8 formed at the front end surface of the key head 3 and then, a cap 9 made of the same material as that of the casing part 5 is fitted in the opening 8 for closing it.

The cap 9 is provided with a pair of leg parts 10 for pressing a front end of the electronic part 4 and for engagement with both side walls of the receptor part 7 tightly. In detail, the leg parts 10 are provided at respective tips thereof with hooks 1O*a*, while the receptor part 7 is provided on both side walls with hooking grooves 7*a*. In inserting the cap 9, the hooks 10*a* are engaged in the hooking grooves 7*a*, respectively, so that the engagement of the cap 9 with the receptor part 7 can be accomplished.

The electronic part 4 is provided on a side edge thereof, which is the nearest to a front corner CF of the key head 3, with a slanted guide surface 4*a* formed obliquely to the front end of the part 4. On the other hand, one of the leg parts 10, which is to be arranged opposite to the slanted guide surface 4*a*, is formed longer than the other leg part 10 so as to go into a wedge-shaped clearance defined between the guide surface 4*a* and the side wall of the receptor part 7. In connection, the longer leg part 10 is also provided on the lateral side facing to the slanted guide surface 4*a* with a slanted surface which is inclined with angles generally equal to that of the guide surface 4*a*.

The outer cover 6 is provided with an opening 11 through which the key part 2*b* of the key plate 1 projects outwardly. Provided on a periphery of the opening 11 are flanges 11*a* which direct inside the key head 3 and abut on the surfaces 1*a*, 1*a* of the key plate 1, respectively.

Furthermore, the outer cover 6 includes additional flanges 8*a* arranged on a periphery of the opening 8 of the receptor part 7. Similarly to the flanges 11*a*, the additional flanges 8*a* are also formed so as to direct inside the key head 3 and to abut on two opposing "insertion" surfaces 9*a* of the cap 9.

On the other hand, the casing part 5 is provided on a front end thereof, in detail, respective front edges of the casing pieces 5*a*, 5*b* with projecting rims 12 for engagement with the flanges 11*a* and 8*a*. Abutting on the flanges 11*a*, 8*a*, the projecting rims 12 operate to urge the flanges 11*a*, 8*a* against the surfaces l*a*, 9*a* and to secure the flanges 11*a*, 8*a* thereon, respectively.

Figure 7:
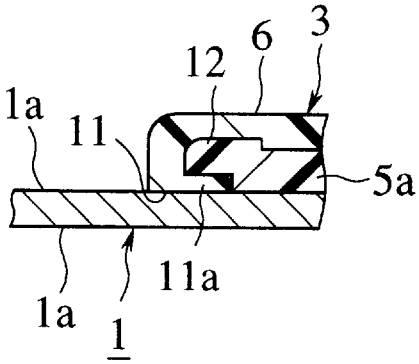
FIG. 7 is an enlarged cross sectional view showing a press-fitting part of a flange.
Figure 8:
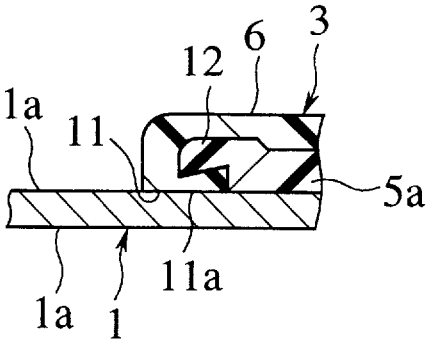
FIG. 8 is an enlarged cross sectional view showing a flange and projecting rims in a modification.

Although the flanges 11*a*, 8*a* in the shown embodiment of FIG. 7 are formed in substantial parallel with the abutting surfaces of the projecting rims 12, it is more preferably that these elements are formed obliquely so as to encroach on each other as shown in FIG. 8.

As mentioned above, in the embodiment, the inward directing flanges 11*a*, 8*a* are formed on the peripheries of the openings 11, 8 of the outer cover 6 of soft synthetic resin and pressed on the surfaces 1*a* of the key plate 1 and the insertion surfaces 9*a* of the cap 9, respectively, by means of the projecting rims 12 provided on the casing part 5 of hard synthetic material. Therefore, even if a force for lifting the peripheries of the openings 11, 8 from the surfaces 1*a*, 9*a* is exerted on the outer cover 6 by the shrinkage in molding the outer cover 6 or the shrinkage with a lapse of time, the movement of the flanges 11, 8 to the lifting direction can be prevented by the projecting rims 12 securely, so that it is possible to prevent the openings 11, 8 from being further opened.

In particular, according to this embodiment, since the further opening of the opening 8 of the receptor part 7 of the electronic part 4 can be prevented even when it is formed at the front end of the key head 3 as mentioned above, there is not raised a problem of producing a clearance between the key head 3 and the cap 9, whereby the appearance of the key plate structure can be improved. Furthermore, since the key plate 1 projects from the front end of the key head 3, it is seldom that the user touches the outer surface of the cap 9 with his fingers. Thus, in case that the cap 9 is made of hard synthetic material, there is no problem of producing a sense of incompatibility for the user.

Again, since the electronic part 4 is provided on one side edge thereof with the slanted guide surface 4*a* and one of the leg parts 10 of the cap 9 is formed longer than the other leg part 10 so as to go into the wedge-shaped clearance defined between the guide surface 4*a* and the side wall of the receptor part 7, it is possible to urge the electronic part 4 against the opposite side wall of the receptor part 7 in addition of urging the part 4 against a bottom wall of the receptor part 7. In connection, it is also possible to fix the electronic part 4 in the receptor part 7 securely without producing any little shaky space.

Further, owing to such an assembling form in which the electronic part 4 can be assembled for the first time when the leg part 10 of the cap 9 slidingly engages with the slanted guide surface 4*a* of the electronic part 4 in fitting the cap 9 into the opening of the receptor part 7, it is possible to exclude such a mistaken assembling that the electronic part 4 is inserted into the receptor part 7 in its reversed condition.

Figure 4:
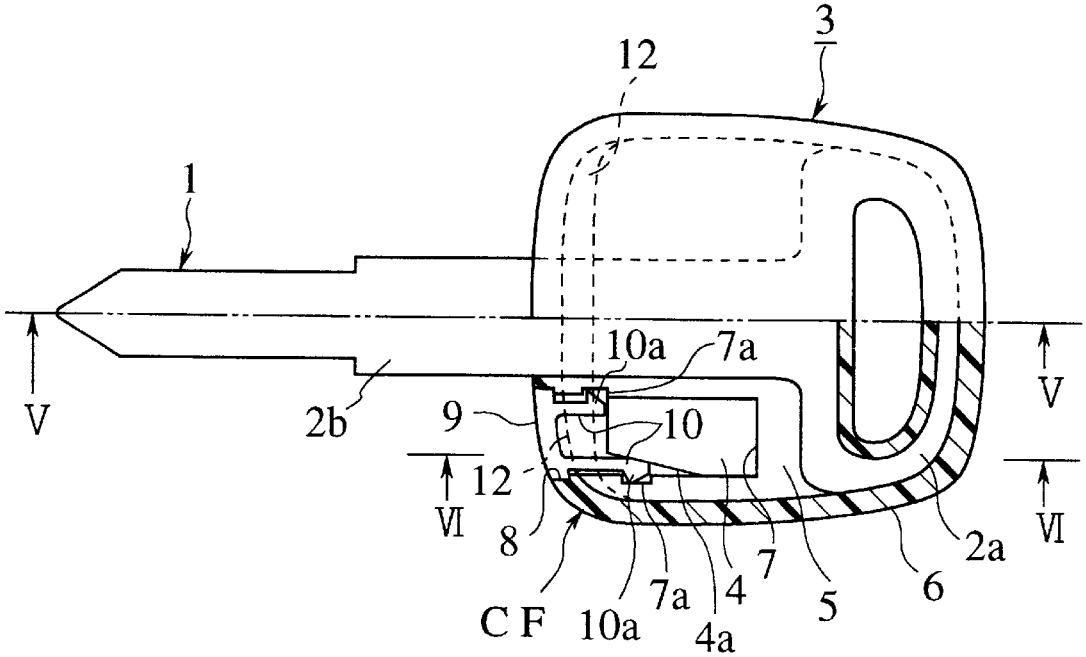
FIG. 4 is a half cross sectional view showing a key plate structure in accordance with a first embodiment of the present invention.

Additionally, since the electronic part 4 is positioned in the key head 3 so that the slanted guide surface 4a is closer to the front corner CF of the key head 3, it is expected that the electronic part 4 would not be a stumbling block in even a case of forming such a rounded corner CF as shown in FIG. 4. Therefore, it is possible to increase degree of freedom in modeling the key head 3.

Figure 9:
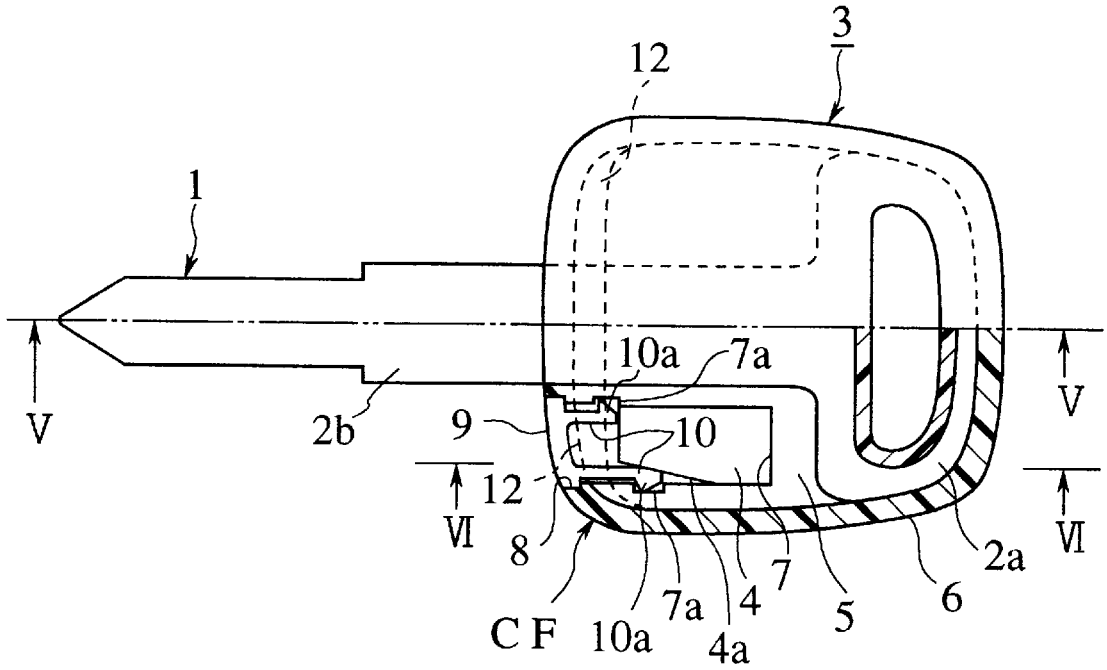
FIG. 9 is a half cross sectional view showing a key plate structure in accordance with a second embodiment of the present invention.
Figure 10:
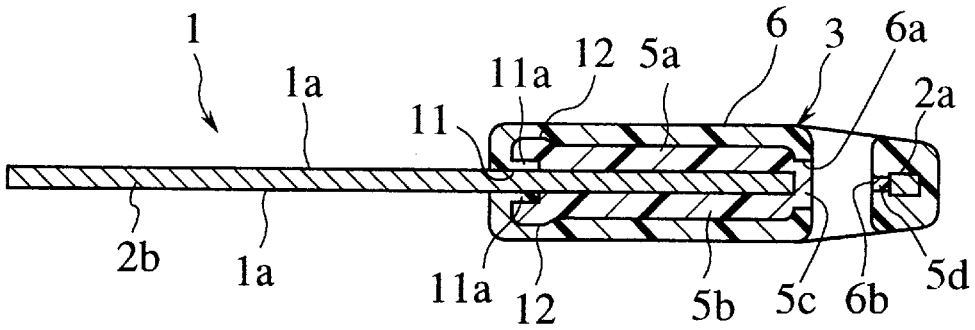
FIG. 10 is a cross sectional view of the key plate structure of the second embodiment of the invention, taken along the line X—X in FIG. 9.

FIGS. 9 and 10 show a second embodiment of the invention wherein similar features illustrated in the first embodiment have been provided with the same reference numbers. The second embodiment includes a casing part 5'and outer cover 6 arrangement different than the first embodiment.

Particularly, the casing part 5 includes two pieces 5*a'* and 5*b'* that meet a common gap portion 5*c'* . The common gap portion 5*c'* is integrally connected to a second gap portion 5*d*. The casing part 5' including the two pieces 5*a'*, 5*b'*, the common gap portion 5*c'*, and the second gap portion 5*d*, is covered by the outer cover 6', so that the common gap portion 5*c'* is located in a first cover gap 6*a* and the second gap portion 5*d* is located in a second cover gap 6*b*.

Covering the casing part 5' with the outer cover 6' so that the common gap portion 5*c'* is located in the first cover gap 6*a* allows the common gap portion 5*c'* to be exposed to an exterior of outer cover 6' and, thus, an exterior of key head 3. Likewise, locating the second gap portion 5*d* in the second cover gap 6*b* allows the second gap portion 5*d* to be exposed to an exterior of the outer cover 6' and, thus, an exterior of the key head 3.

Although the common gap portion 5*c'* and the second gap portion 5*d* are exposed to an exterior of the key head 3, each portion is exposed in an area of the key head 3 such that a user's finger would rarely come into contact with these portions. Thus, the risk that a user would remove the outer cover 6' from the casing part 5 is reduced.

Figure 11:
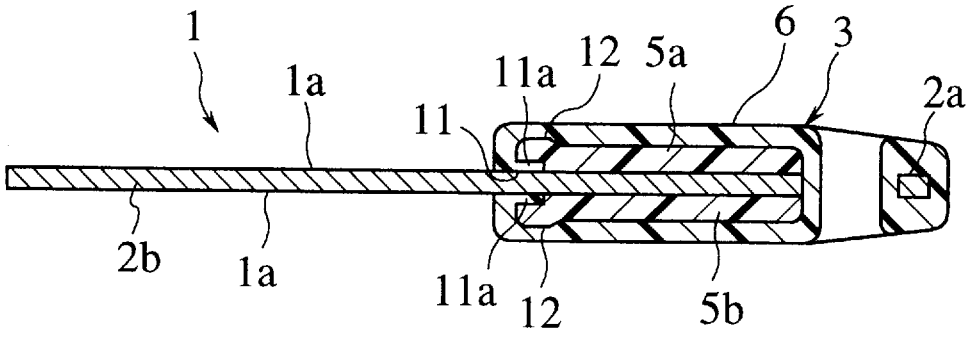
FIG. 11 is a cross sectional view of a third embodiment of the present invention.

In contrast to the exposed portions of the casing part 5 as discussed above with regard to the first and second embodiments of the present invention, FIG. 11 shows a third embodiment of the present invention in which the cover 6" entirely covers casing pieces 5*a"* and 5*b"* of the casing part 5.

Finally, it will be understood by those skilled in the art that the foregoing description is one of preferred embodiments of the disclosed key plate structure, and that various changes and modifications may be made to the present invention without departing from the spirit and scope thereof

What is claimed is:

1. A key plate structure for an automobile, comprising:

a key plate comprising a head part and a key part formed integrally with said head part and extending therefrom; and a key head comprising a casing part made of synthetic resin for enclosing said head part and a portion of said key part of said key plate, said casing part having an electronic part installed on one side thereof and adjacent to said key plate, and an outer cover made of synthetic resin for substantially encapsulating said casing part, said outer cover being provided with an opening through which a portion of said key part projects outwardly, said synthetic resin of said casing part being harder than said synthetic resin of said outer cover, wherein said outer cover has flanges formed on a periphery of said opening, said flanges extending inside said key head and abutting on opposite surfaces of said key plate, respectively;

wherein said casing part has projecting rims formed on one edge thereof to urge said flanges of said outer cover against said opposite surfaces of said key plate and to fix said flanges on said surfaces, respectively.

2. A key plate structure as claimed in claim 1, wherein said casing part is provided with a chamber for accommodating said electronic part therein, which opens at an end surface of said key head.

3. A key plate structure for an automobile, comprising:

a key plate comprising a head part and a key part formed integrally with said head part and extending therefrom; and a key head comprising a casing part made of synthetic resin for enclosing said head part and a portion of said key part of said key plate, said casing part having an electronic part installed on one side thereof and adjacent to said key plate, and an outer cover made of soft synthetic resin for covering said casing part, said outer cover being provided with an opening through which a part portion of said key part projects outwardly, and a synthetic resinous cap which is fitted in said chamber for accommodating said electronic part therein firmly and which is provided with a pair of leg parts for engagement with opposing side walls of said chamber;

wherein said outer cover has flanges formed on a periphery of said opening, said flanges extending inside said key head and abutting on opposite surfaces of said key plate, respectively;

wherein said casing part has projecting rims formed on one edge thereof to urge said flanges of said outer cover against said opposite surfaces of said key plate and to fix said flanges on said surfaces, respectively; and wherein said outer cover has additional flanges formed about a periphery of an opening of said chamber, said additional flanges also extending inside said key head and abutting on opposing surfaces of said cap, respectively and said additional flanges are urged and fixed against said cap by said projecting rims of said casing part.

4. A key plate structure as claimed in claim 3, wherein said leg parts are provided at respective tips thereof with hooks and said chamber is provided on the opposing side walls thereof with hooking grooves for engagement with said hooks.

5. A key plate structure as claimed in claim 4, wherein one of said leg parts is longer than the other of said leg parts.

6. A key plate structure as claimed in claim 5, wherein said electronic part is provided on one side thereof with a slanted guide surface which is oblique to an end surface of said electronic part facing said cap;

wherein said cap is fitted in said chamber so that said longer one of said leg parts is inserted between said slanted guide surface and one of said opposing side walls of said chamber.

7. A key plate structure as claimed in claim 6, wherein said slanted guide surface is arranged on a side of said electronic part, which is closer to a corner of said key head than the other opposing side of said electronic part.

8. The key plate structure as claimed in claim 1, wherein said outer cover entirely covers said casing part.

9. A key structure comprising:

a key including a head part and a key part extending from said head part, said key part having at least one flat surface; and a key head including:

a casing part that encloses at least a portion of each of said head part and said key part, said casing part having at least one projecting rim, and an outer cover that substantially encapsulates said casing part, said outer cover having an opening with at least one flange that is urged against said at least one flat surface of said key part by said at least one projecting rim.

10. The key structure of claim 9, wherein said at least one projecting rim urges said at least one flange against said at least one flat surface to fix said at least one flange on said at least one flat surface.

11. The key structure of claim 9, wherein said at least one flat surface comprises two opposite side surfaces of a flat plate.

12. The key structure of claim 11, wherein said at least one flange comprises two flanges; and wherein each of said two flanges is, respectively, fixed against one of said two opposite side surfaces.

13. The key structure of claim 12, wherein said at least one projecting rim comprises two projecting rims; and wherein each of said two projecting rims, respectively, fixes one of said two flanges against one of said two opposite side surfaces.

14. The key structure of claim 9, wherein said casing part comprises hard synthetic resin.

15. The key structure of claim 9, further comprising an electronic part installed on one side of said casing part and adjacent said key part.

16. The key structure of claim 14, wherein said outer cover comprises synthetic resin softer than said synthetic resin of said casing part.

17. The key structure of claim 9, wherein said at least one flange is formed on a periphery of said opening so that a part of said key part projects outwardly through said opening and said at least one flange extends inside said key head to abut said at least one flat surface.

18. The key structure of claim 9, wherein said outer cover entirely covers said casing part.

19. The key structure of claim 9, wherein said head part and said key part are integral.

20. The key structure of claim 9, wherein said at least one projecting rim is formed on an edge of said casing part.

21. The key structure of claim 9, wherein said at least one casing part comprises two casing pieces on opposite sides of said key.

22. The key structure of claim 21, wherein said outer cover covers said two casing pieces so that one of said two casing pieces is entirely covered and the other of said two casing pieces is partially covered so that a gap portion of the other of said two casing pieces is exposed to an exterior of said outer cover.

23. The key structure of claim 21, wherein said outer cover covers said two casing pieces so that each of said two casing pieces is partially covered so that a common gap portion of each casing piece is exposed to an exterior of said outer cover.

* * * * *